US009070504B2

(12) United States Patent
Liu

(10) Patent No.: US 9,070,504 B2
(45) Date of Patent: Jun. 30, 2015

(54) TRANSFORMER AND FABRICATING METHOD FOR TRANSFORMER

(71) Applicant: Chih-Shien Liu, Taoyuan County (TW)

(72) Inventor: Chih-Shien Liu, Taoyuan County (TW)

(73) Assignee: FSP TECHNOLOGY INC., Taoyuan (TW)

( * ) Notice: Subject to any disclaimer, the term of this patent is extended or adjusted under 35 U.S.C. 154(b) by 63 days.

(21) Appl. No.: 13/629,624

(22) Filed: Sep. 28, 2012

(65) Prior Publication Data

US 2013/0082811 A1 Apr. 4, 2013

(30) Foreign Application Priority Data

Sep. 29, 2011 (TW) ..... 100135297 A

(51) Int. Cl.

| | |
|---|---|
| ***H01F 27/29*** | (2006.01) |
| ***H01F 27/28*** | (2006.01) |
| ***H01F 27/30*** | (2006.01) |
| ***H01F 30/12*** | (2006.01) |
| ***H01F 27/32*** | (2006.01) |

(52) U.S. Cl.

CPC ..... *H01F 27/29* (2013.01); *Y10T 29/4902* (2015.01); *H01F 27/325* (2013.01)

(58) Field of Classification Search

CPC ..... H01F 27/306; H01F 27/325; H01F 27/28; H01F 27/29; H01F 27/292; H01F 27/2804; H01F 17/0013; H01F 30/06; H01F 38/10

USPC ..... 336/192, 170, 196, 5

See application file for complete search history.

(56) References Cited

U.S. PATENT DOCUMENTS

| | | | | |
|---|---|---|---|---|
| 3,398,292 | A * | 8/1968 | Kuba | 307/51 |
| 6,344,786 | B1 * | 2/2002 | Chin | 336/198 |
| 7,274,282 | B2 * | 9/2007 | Park et al. | 336/192 |
| 8,054,152 | B2 * | 11/2011 | Tseng et al. | 336/192 |
| 2003/0098769 | A1 * | 5/2003 | Cheung et al. | 336/208 |
| 2007/0296535 | A1 * | 12/2007 | Fushimi | 336/200 |
| 2008/0278274 | A1 * | 11/2008 | Kang et al. | 336/198 |
| 2010/0013588 | A1 * | 1/2010 | Sakuma | 336/198 |
| 2011/0037554 | A1 * | 2/2011 | Tsai et al. | 336/196 |
| 2011/0187485 | A1 * | 8/2011 | Toyoda et al. | 336/192 |
| 2012/0007706 | A1 * | 1/2012 | Wetteland | 336/60 |

* cited by examiner

*Primary Examiner* — Elvin G Enad
*Assistant Examiner* — Kazi Hossain
(74) *Attorney, Agent, or Firm* — Jianq Chyun IP Office

(57) ABSTRACT

A transformer and a fabricating method for transformer. The transformer includes a stand, two primary-sides, a secondary-side and multiple pins. The stand has a top-portion, a bottom-portion and a middle-portion connecting the top-portion and the bottom-portion. The primary-sides are disposed on the middle-portion and the secondary-side is disposed on the middle-portion between and insulated from the two primary-sides. The pins are plugged under the bottom-portion and electrically connected to the primary-sides and the secondary-side, wherein each of the primary-sides and secondary-side has multiple thread-ends respectively connecting one pin. The bottom-portion has multiple slots corresponding to the pins. The slot length is greater than a safety-standard distance, no insulating sleeve is disposed on the thread-ends, and the thread-ends are electrically connected to the pins along the slots so that a distance between the electrical connection joint and the primary-sides or the secondary-side on the middle-portion is greater than the safety-standard distance.

7 Claims, 3 Drawing Sheets

TRANSFORMER AND FABRICATING METHOD FOR TRANSFORMER

CROSS-REFERENCE TO RELATED APPLICATION

This application claims the priority benefit of Taiwan application serial no. 100135297, filed on Sep. 29, 2011. The entirety of the above-mentioned patent application is hereby incorporated by reference herein and made a part of this specification.

BACKGROUND OF THE INVENTION

1. Field of the Invention

The invention relates to a transformer and a fabricating method for transformer.

2. Description of Related Art

The transformer has a variety of different forms to adapt to the different functional requirements, and the transformer design must take performance specifications such as transformer ratio, current loss as well as size in consideration. Due to the huge current and noticeable voltage variation during the operation of transformer, a strict safety test must be conducted to ensure the safety. To meet the safety-standard requirement, the thread-ends of the coil of a transformer wear insulating sleeves and an isolation tape is placed at the coil close to the pins so as to increase the insulation distance kept between the connection place of thread and pin and the coil. However, whether the thread-ends are put on with the insulating sleeves steps or placing the isolation tape on the transformer, these jobs must be manually done and fail to take advantage of machine automation to be done, which largely increases the complexity of the process, also leads to the more labor hours and the higher cost.

SUMMARY OF THE INVENTION

Accordingly, the invention is directed to a transformer for solving the conventional problem caused by essentially employing the insulating sleeves therein.

The invention is also directed to a transformer for solving the conventional problem caused by essentially employing the isolation tape therein.

The invention is directed to a fabricating method for transformer for solving the conventional problem that the fabricating in the prior art must be manually conducted.

The invention provides a transformer, which includes a stand, two primary-sides, a secondary-side and a plurality of pins. The stand has a top-portion, a bottom-portion and a middle-portion connecting the top-portion and the bottom-portion. The primary-sides are disposed on the middle-portion; the secondary-side is disposed on the middle-portion and between the two primary-sides and insulated from the primary-sides; and the pins are plugged under the bottom-portion and electrically connected to the primary-sides and the secondary-side, in which each of the primary-sides and the secondary-side has a plurality of thread-ends respectively and correspondingly connected to one of the pins. The bottom-portion has a plurality of slots corresponding to the pins, in which the length of the slots is greater than a safety-standard distance, no insulating sleeve is disposed on the thread-ends, and the thread-ends are electrically connected to the pins along the slots so that a distance between the electrical connection joint and the primary-sides or the secondary-side on the middle-portion is greater than the safety-standard distance.

In an embodiment of the present invention, there is no positioning layer disposed between each of the primary-sides or the secondary-side and the bottom-portion or the top-portion.

In an embodiment of the present invention, each of the primary-sides is a single-stranded coil.

In an embodiment of the present invention, the secondary-side includes a metallic strip and a plurality of wires, in which partial wires connect the middle of the metallic strip, partial wires connect an end of the metallic strip and the rest wires connect the other end of the metallic strip.

In an embodiment of the present invention, a surface of the bottom-portion is a step shape and the pins are disposed at the protruding portion of the step shape.

In an embodiment of the present invention, the depth of each of the slots is adjustable correspondingly to the positions at the middle-portion where the primary-sides and the secondary-side are disposed at.

In an embodiment of the present invention, when the operation voltage of the transformer is 125V, the length of the slot is greater than 3 mm; when the operation voltage of the transformer is 150V, the length of the slot is greater than 3.2 mm; when the operation voltage of the transformer is 200V, the length of the slot is greater than 4 mm; when the operation voltage of the transformer is 250V, the length of the slot is greater than 5 mm; when the operation voltage of the transformer is 300V, the length of the slot is greater than 6.4 mm; when the operation voltage of the transformer is 400V, the length of the slot is greater than 8 mm; when the operation voltage of the transformer is 600V, the length of the slot is greater than 12.6 mm; and when the operation voltage of the transformer is 800V, the length of the slot is greater than 16 mm.

The fabricating method for transformer of the invention includes following steps: disposing a first primary-side by a machine on a middle-portion of a stand, in which the stand has a top-portion, a bottom-portion and the middle-portion connecting the top-portion and the bottom-portion, the bottom-portion has a plurality of slots corresponding to a plurality of pins and the length of the slots is greater than a safety-standard distance; electronically connecting the first primary-side by the machine to multiple pins among the above-mentioned pins on the bottom-portion; disposing a secondary-side by the machine on the first primary-side on the middle-portion, in which the secondary-side is insulated from the first primary-side; electronically connecting the secondary-side by the machine to other pins on the bottom-portion; disposing a second primary-side on the secondary-side on the middle-portion, in which the secondary-side is insulated from the second primary-side; and electronically connecting the second primary-side by the machine to additional the rest pins on the bottom-portion.

In an embodiment of the present invention, the first primary-side, the second primary-side and the secondary-side respectively have a plurality of thread-ends respectively connecting one of the pins, in which no insulating sleeves are disposed on the thread-ends, and the thread-ends are electrically connected to the pins along the slots so that a distance between the electrical connection joint and the first primary-side, the second primary-side or the secondary-side on the middle-portion is greater than the safety-standard distance.

In an embodiment of the present invention, there is no positioning layer disposed between the first primary-side, the second primary-side or the secondary-side and the bottom-portion or the top-portion.

In an embodiment of the present invention, the depth of each of the slots is adjustable correspondingly to the positions at the middle-portion where the primary-sides and the secondary-side are disposed at.

Based on the description above, in the transformer and the fabricating method for transformer of the invention, the conventional design of employing the insulating sleeves is replaced by controlling the length of the slots of the bottom-portion in the invention so as to achieve a distance greater than the insulation distance required by the safety-standard and therefore to save labor and cost caused by employing the insulating sleeves.

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE EMBODIMENTS

Figure 1:
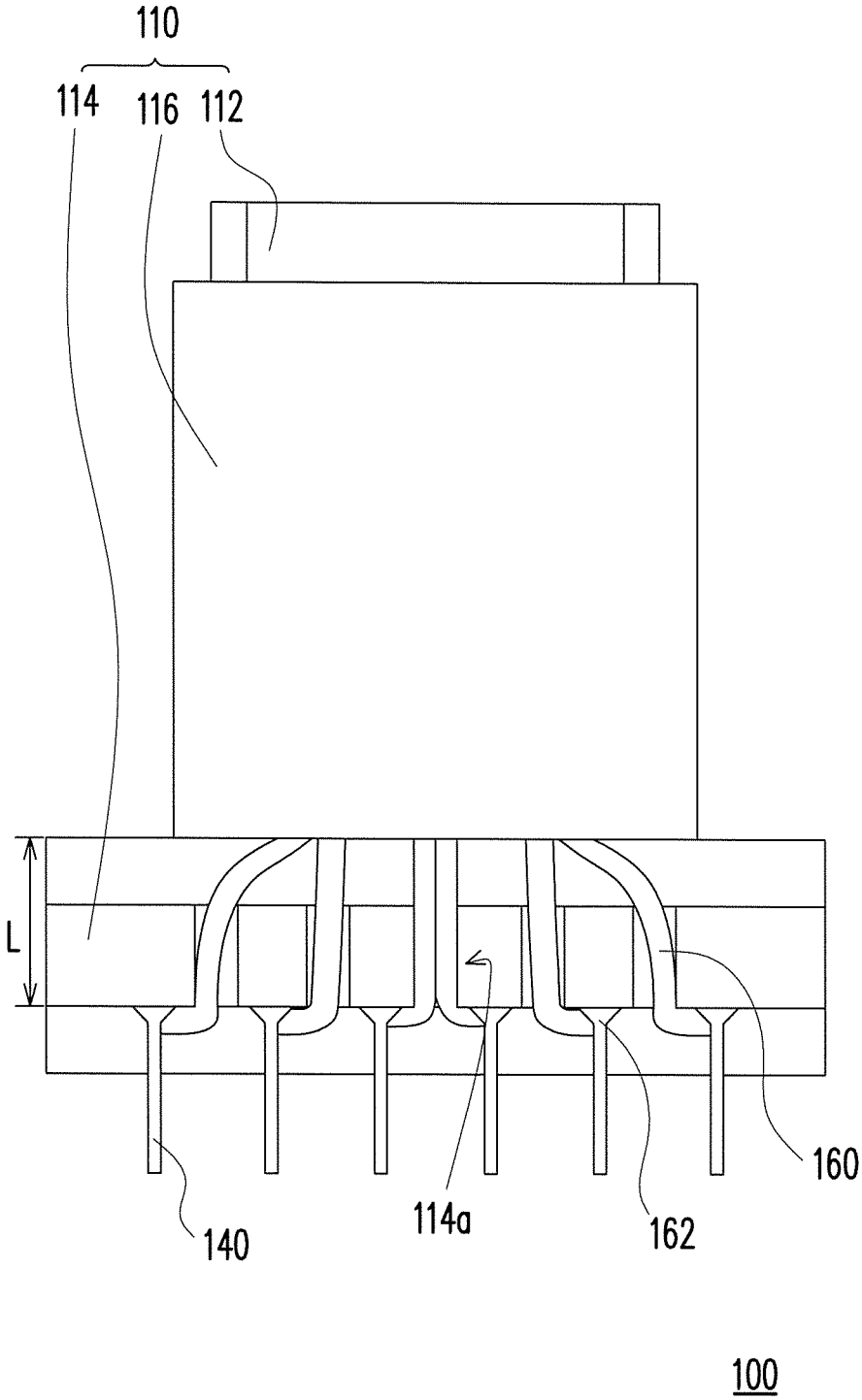
FIG. 1 is a side-view of a transformer according to an embodiment of the invention.
Figure 2:
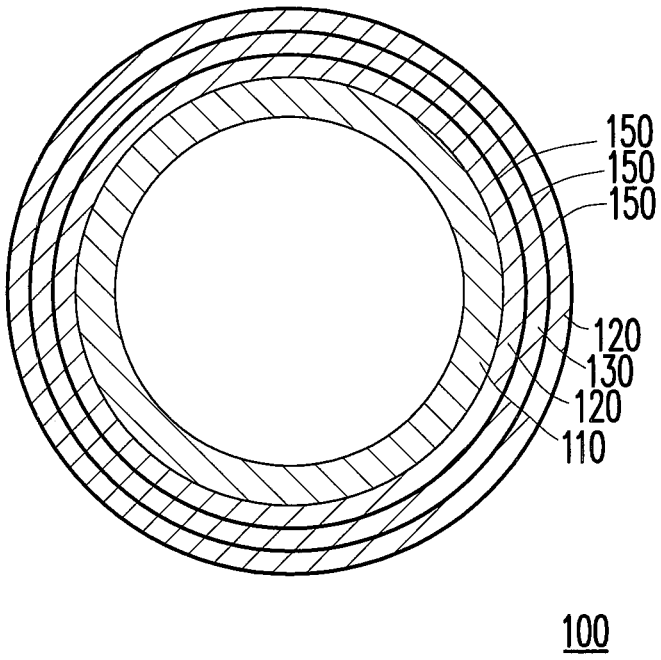
FIG. 2 is a cross-sectional diagram of the transformer of FIG. 1.

FIG. 1 is a side-view of a transformer according to an embodiment of the invention and FIG. 2 is a cross-sectional diagram of the transformer of FIG. 1. Referring FIGS. 1 and 2, a transformer 100 includes a stand 110, two primary-sides 120, a secondary-side 130 and a plurality of pins 140. The stand 110 has a top-portion 112, a bottom-portion 114 and a middle-portion 116, in which the middle-portion 116 is connected between the top-portion 112 and the bottom-portion 114, the two primary-sides 120 and the secondary-side 130 are disposed on the middle-portion 116 of the stand 110, and the secondary-side 130 is located between the two primary-sides 120 and insulated from the primary-sides 120. In the embodiment, the secondary-side 130 is insulated from the primary-sides 120 by using an insulation tape 150 and the outmost primary-side 120 is also adhered by the insulation tape 150 to advance the safety.

The pins 140 are plugged under the bottom-portion 114 and electrically connected to the primary-sides 120 or the secondary-side 130. Each of the primary-sides 120 and the secondary-side 130 respectively have a plurality of thread-ends 160 and each of the thread-ends 160 connects a pin 140. The bottom-portion 114 has a plurality of slots 114*a* corresponding to the pins 140. The length of the slots 114*a* is greater than a safety-standard distance. The thread-ends 160 have no the conventional insulating sleeves thereon and are electrically connected to the pins 140 along the slots 114*a*. The electrical connection joints 162 between the thread-ends 160 and the pins 140 respectively have a distance L greater than the length specified by the safety-standard from the primary-sides 120 or the secondary-side 130 on the middle-portion 116.

In the embodiment, since the bottom-portion 114 of the stand 110 of the transformer 100 provides the slots 114*a* with a length greater than the distance specified by the safety-standard so that the electrical connection joints 162 between the thread-ends 160 and the pins 140 respectively have a distance L greater than the length specified by the safety-standard from the primary-sides 120 or the secondary-side 130 without employing the insulating sleeves used by the conventional transformer and thus, the transformer 100 in the embodiment can save the cost required by employing the insulating sleeves.

In the transformer 100 of the embodiment, there is no need of employing and there is no positioning layer or insulation tape disposed between each of the primary-sides 120 or the secondary-side 130 and the bottom-portion 114 or the top-portion 112 because the distance between the electrical connection joints 162 of the thread-ends 160 and the pins 140 and the primary-sides 120 or the secondary-side 130 has kept to be greater than the safety-standard distance. In turns of the conventional transformer however, in order to meet the safety requirement, tape or other insulation materials are used to dispose a positioning layer between the primary-sides 120 or the secondary-side 130 and the bottom-portion 114 or the top-portion 112, which increases the labor and cost.

Each of the primary-sides 120 in the embodiment can adopt a single-stranded coil. In the prior art, it is needed to manually dispose the insulating sleeves and after disposing the primary-sides by the machine the manual processing is further required, which has even higher cost than directly and manually disposing the primary-sides and the insulating sleeves. Although in the prior art, it is hoped to directly and manually dispose the primary-sides in the transformer, but workers may fail to smoothly dispose the primary-sides made of single-stranded coil since the wires of the single-stranded coil are too thick to easily bend them. In the embodiment, the transformer 100 has no need to manually dispose the insulating sleeves, therefore the primary-sides 120 can be disposed by using the machine and the single-stranded coil is feasible to make the primary-sides 120. It should be noted that for the primary-sides 120 made of the single-stranded coil, the integral impedance is lower than the impedance of the conventional primary-sides made of multi-stranded coil, which further advances the efficiency of the transformer 100 of the embodiment.

Figure 3:
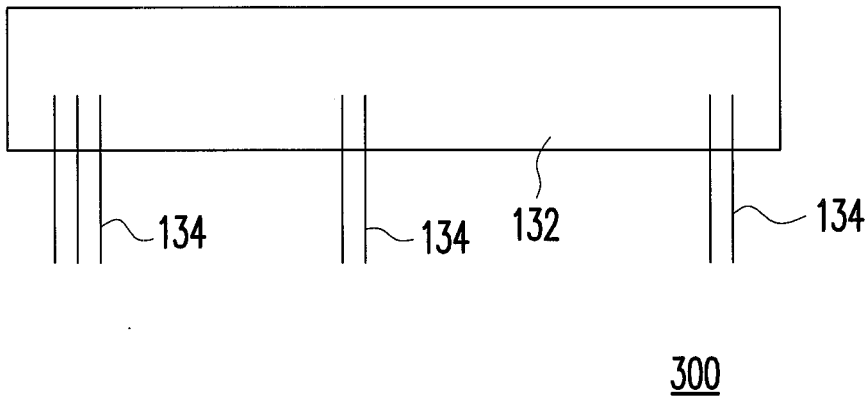
FIG. 3 is an unwound diagram of the secondary-side of the transformer in FIG. 1.

FIG. 3 is an unwound diagram of the secondary-side of the transformer in FIG. 1. Referring to FIG. 3, the secondary-side 130 of the embodiment includes a metallic strip 132 and seven wires 134, in which two wires 134 are connected to the middle of the metallic strip 132, two wires 134 are connected to an end of the metallic strip 132 and the rest three wires 134 are connected to the other end of the metallic strip 132.

Figure 4:
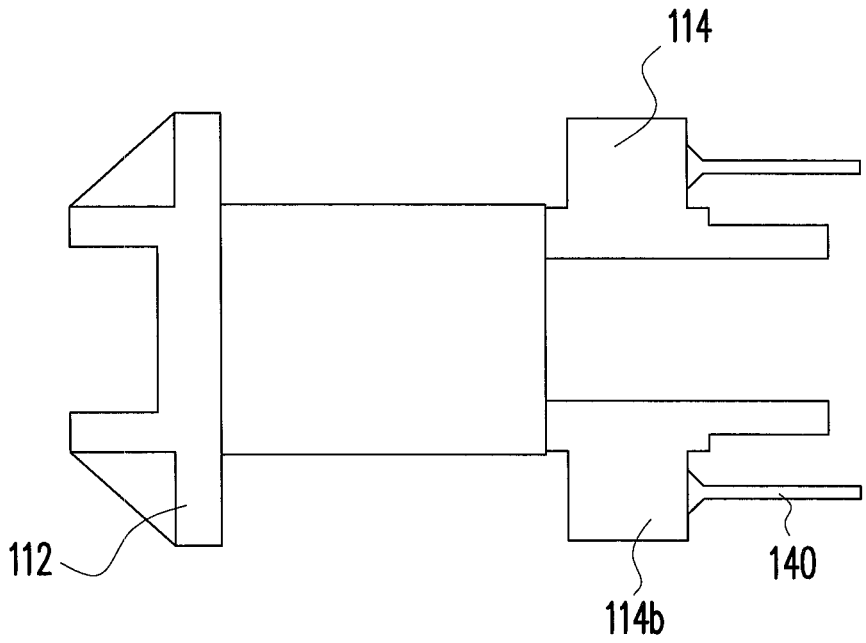
FIG. 4 is another side-view of the transformer of FIG. 1.

FIG. 4 is another side-view of the transformer of FIG. 1. Referring to FIG. 4, a surface of the bottom-portion 114 in the embodiment is in step shape and the pins 140 are disposed at the protruding portion in step shape.

Figure 5:
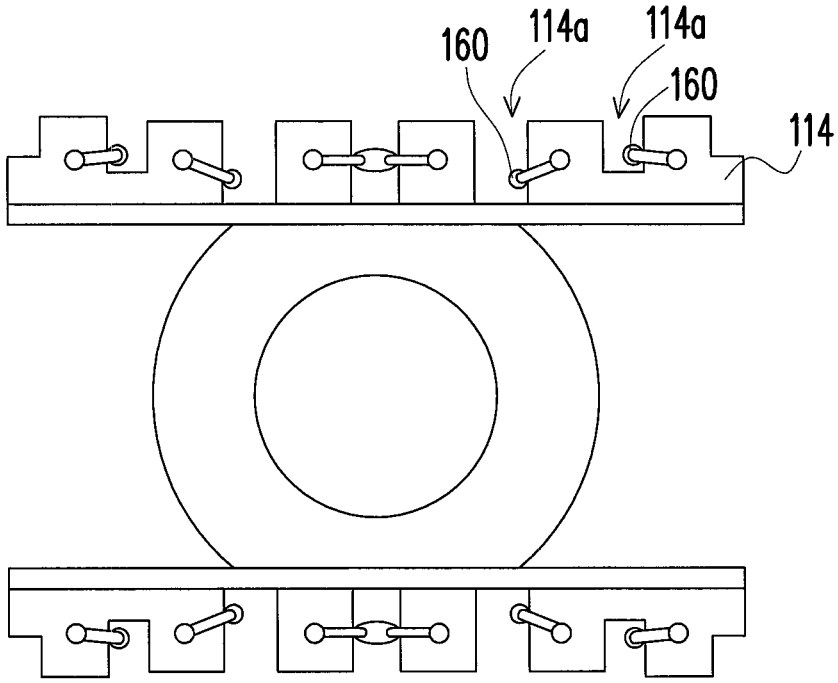
FIG. 5 is a bottom-view of the transformer of FIG. 1.

FIG. 5 is a bottom-view of the transformer of FIG. 1. Referring to FIGS. 2 and 5, the depth of each of the slots 114*a* is adjustable correspondingly to the positions at the middle-portion 116 where the primary-sides 120 and the secondary-side 130 are disposed at. In more details, the thread-ends 160 of the primary-side 120 most close to the middle-portion 116 passes through the deepest slot 114*a*, while the thread-ends 160 of the primary-side 120 most far away from the middle-portion 116 passes through the shallower slot 114*a*. In the embodiment, in view of the single side of the bottom-portion 114, the depths of three slots 114*a* located in the middle are deeper, while the depths of two slots 114*a* located at two sides are shallower.

In the embodiment, for different operation voltages of the transformer 100, the length of the slots 114*a* can be changed accordingly to be sufficiently greater than the safe distance.

For example, when the operation voltage of the transformer 100 is 125V, the length of the slot 114*a* is greater than 3 mm; when the operation voltage of the transformer 100 is 150V, the length of the slot 114*a* is greater than 3.2 mm; when the operation voltage of the transformer 100 is 200V, the length of the slot 114*a* is greater than 4 mm; when the operation voltage of the transformer 100 is 250V, the length of the slot 114*a* is greater than 5 mm; when the operation voltage of the transformer 100 is 300V, the length of the slot 114*a* is greater than 6.4 mm; when the operation voltage of the transformer 100 is 400V, the length of the slot 114*a* is greater than 8 mm; when the operation voltage of the transformer 100 is 600V, the length of the slot 114*a* is greater than 12.6 mm; and when the operation voltage of the transformer 100 is 800V, the length of the slot 114*a* is greater than 16 mm.

The fabricating method for transformer is described according to an embodiment of the invention referring to FIGS. 1 and 2. First, a machine (not shown) is used to dispose a first primary-side 120 on the middle-portion 116 of the stand 110, in which the machine means one able to finish each assembling step automatically and the machine of each step can be an independent but in series connection machine or a single machine. Next, the first primary-side 120 is electrically connected to a plurality of pins 140 on the bottom-portion 114 by the machine through wedding or other processes. Then, the secondary-side 130 is disposed on the primary-side 120 on the middle-portion 116 by the machine. Meanwhile the insulation of the secondary-side 130 from the first primary-side 120 is ensured, for example, by using the insulation tape 150. Thereafter, the secondary-side 130 is electrically connected to the other pins 140 on the bottom-portion 114 by the machine. Further, a second primary-side 120 is disposed on the secondary-side 130 on the middle-portion 116 by the machine. Meanwhile, the insulation of the secondary-side 130 from the second primary-side 120 is ensured, for example, by using the insulation tape 150. Finally, the second primary-side 120 is electrically connected to the rest multiple pins 140 on the bottom-portion 114 by the machine.

Since in the fabricating method for transformer of the embodiment, there is no need to manually sleeve with the insulating sleeves so that all the steps can be automatically finished by machine, which largely reduces the labor and the cost and enhances the feasibility of mass production.

In the fabricating method for transformer of the embodiment, there is no need to sleeve the thread-ends 160 of the primary-sides 120 and the secondary-side 130, and the distance between the electrical connection joints 162 of the thread-ends 160 and the pins 140 and the primary-sides 120 or the secondary-side 130 has kept to be greater than the safety-standard distance. In addition, there is no need of employing and there is no positioning layer disposed between each of the primary-sides 120 or the secondary-side 130 and the bottom-portion 114 or the top-portion 112. The depth of each of the slots 114*a* is adjustable correspondingly to the positions at the middle-portion 116 where the primary-sides 120 and the secondary-side 130 are disposed at.

In summary, in the transformer and the fabricating method for transformer of the invention, the distance between the electrical connection joints of the thread-ends of the primary-sides or the secondary-side and the pins and the primary-sides or the secondary-side is kept to be greater than the safety-standard distance without employing the conventional insulating sleeves, which can largely reduce material cost required by the insulating sleeves. Moreover the machine can be used to finish the fabrication of whole transformer so as to save the labor and the cost.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A transformer, comprising:

a stand, having a top-portion, a bottom-portion and a middle-portion connecting the top-portion and the bottom-portion;

two primary-sides, disposed on the middle-portion;

a secondary-side, disposed on the middle-portion and between the two primary-sides and isolated from the primary-sides; and a plurality of pins, plugged under the bottom-portion and electrically connected to the primary-sides and the secondary-side, wherein each of the primary-sides and the secondary-side has a plurality of thread-ends respectively and correspondingly connected to one of the pins, wherein the bottom-portion has a plurality of slots corresponding to the pins, length of the slots is greater than a safety-standard distance, and no insulating sleeve is disposed on the thread-ends, the thread-ends arranged along the slots are electrically connected to the pins, the thread-ends are sections of coils of the primary-sides and the secondary-side extending from a boundary between the middle portion and the bottom portion to the pins.

2. The transformer as claimed in claim 1, wherein there is no positioning layer disposed between each of the primary-sides or the secondary-side and the bottom-portion or the top-portion.

3. The transformer as claimed in claim 1, wherein each of the primary-sides is a single-stranded coil.

4. The transformer as claimed in claim 1, wherein the secondary-side comprises a metallic strip and seven wires, two wires connect the middle of the metallic strip, two wires connect an end of the metallic strip and the rest three wires connect the other end of the metallic strip.

5. The transformer as claimed in claim 1, wherein a surface of the bottom-portion is a step shape and the pins are disposed at the protruding portion of the step shape.

6. The transformer as claimed in claim 5, wherein depth of each of the slots is adjustable correspondingly to the positions at the middle-portion where the primary-sides and the secondary-side are disposed at.

7. The transformer as claimed in claim 6, wherein when the operation voltage of the transformer is 125V, the length of the slot is greater than 3 mm;

when the operation voltage of the transformer is 150V, the length of the slot is greater than 3.2 mm;

when the operation voltage of the transformer is 200V, the length of the slot is greater than 4 mm;

when the operation voltage of the transformer is 250V, the length of the slot is greater than 5 mm;

when the operation voltage of the transformer is 300V, the length of the slot is greater than 6.4 mm;

when the operation voltage of the transformer is 400V, the length of the slot is greater than 8 mm;

when the operation voltage of the transformer is 600V, the length of the slot is greater than 12.6 mm; and when the operation voltage of the transformer is 800V, the length of the slot is greater than 16 mm.

* * * * *